United States Patent [19]

Kohls

[11] 3,948,302

[45] Apr. 6, 1976

[54] FOLDABLE SKI COVER

[76] Inventor: Richard S. Kohls, 415 1st North, Seattle, Wash. 98109

[22] Filed: Sept. 25, 1974

[21] Appl. No.: 509,105

Related U.S. Application Data

[63] Continuation of Ser. No. 396,691, Sept. 13, 1973, Pat. No. 3,851,689.

[52] U.S. Cl. ..... 150/52 R

[51] Int. Cl.[2] ..... A45C 11/00

[58] Field of Search ..... 150/1, 3, 7, 52 R; 190/51

[56] References Cited

UNITED STATES PATENTS

| | | | |
|---|---|---|---|
| 1,818,030 | 8/1931 | Arnold | 150/1 |
| 3,203,551 | 8/1965 | Van Loan | 150/7 X |
| 3,245,448 | 4/1966 | Rea | 150/52 R |
| 3,336,961 | 8/1967 | Welsh | 150/52 R |
| 3,851,689 | 12/1974 | Kohls | 150/52 R |

FOREIGN PATENTS OR APPLICATIONS

| | | | |
|---|---|---|---|
| 120,642 | 1/1931 | Austria | 150/52 R |

*Primary Examiner*—Donald F. Norton
*Attorney, Agent, or Firm*—Seed, Berry, Vernon & Baynham

[57] ABSTRACT

A bag for carrying and storing a pair of skis is constructed of a flexible, substantially waterproof material and is of generally elongated construction closed at one end and open at the other and is divided by a longitudinally extending partition into two compartments. The bag consists of an elongated, generally tubular front portion, an elongated, generally tubular rear portion of greater cross-sectional area than the front portion and an intermediate portion integral with the front and rear portions to form a continuous, elongated bag. The bag is longer than the skis and the open end of the bag is adapted to be folded on itself to close the bag. A plurality of fastening means, preferably velvet type fabric hook fasteners, are employed along the length of the bag to fasten the bag around the skis.

3 Claims, 10 Drawing Figures

FOLDABLE SKI COVER

This is a continuation of application Ser. No. 396691, filed Sept. 13, 1973, now Pat. No. 3,851,689.

The present invention relates to bags for carrying and storing skis, and, more particularly, to a bag designed to securely hold a pair of skis in different positions.

Portable, flexible material bags for carrying and storing skis are generally well known. Most such bags permit carrying both skis of a ski pair in a single compartment in a fixed position, i.e., the skis may be carried side-by-side or bottom-to-bottom. Some bags provide compartments which are sufficiently large that the skis are able to move around and shift positions within the compartment. The former type of bag is undesirable since it limits the positioning of the skis therein and cannot be used for applications. The latter type bag provides inadequate protection for the skis.

It has been observed that when hand carrying skis it is desirable that the skis be positioned with their bottoms facing each other. This is also the required position for the skis for mounting on certain ski racks. However, there are also ski racks which require the skis to rest flatly thereon in side-by-side relation. No presently available bag provides adequate protection to the skis by preventing movement of the skis within the bag while at the same time is sufficiently flexible to permit the skis to be disposed in either bottom-to-bottom or side-by-side configuration.

It is therefore an object of this invention to provide a flexible ski bag which completely encloses the skis and which permits the skis to assume any desired disposition therein, yet which restricts movement of the skis in the bag thereby avoiding damage to the skis.

It is another object of the invention to provide a ski carrying and storing bag which allows the skis to be carried in either side-by-side or bottom-to-bottom positions and to be shifted from one position to the other without removing the skis from the bag.

It is still another object of the invention to provide a two compartment bag whereby a single ski may be stored in each compartment and the skis thereby prevented from contacting and damaging each other.

Other objects and advantages will become apparent from the following description and appended claims taken in conjunction with the accompanying drawings.

The ski carrying and storing bag of the present invention is constructed of a light, waterproof material which is extremely flexible and is readily adapted to receive and enclose a pair of skis and their bindings therein. The bag is designed to store the skis in either bottom-to-bottom or side-by-side position and to permit the skis to be readily shiftable from one position to the other without removing the skis from the bag. In addition, the bag includes two compartments for receiving individual skis in each compartment to protect the skis from each other. When enclosed within the bag the skis are covered and protected from dirt, grit, salt and the like to which the skis may otherwise be exposed during transportation on a vehicle. A particular advantage of the bag of the present invention is that it is designed so that it can be folded into a very small package and easily carried in a pocket.

Figure 7:
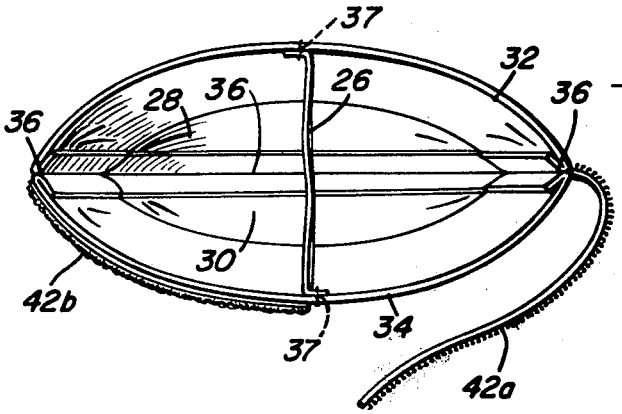
FIG. 7 is an end view of the bag of the present invention looking into the open end of the bag.
Figure 8:
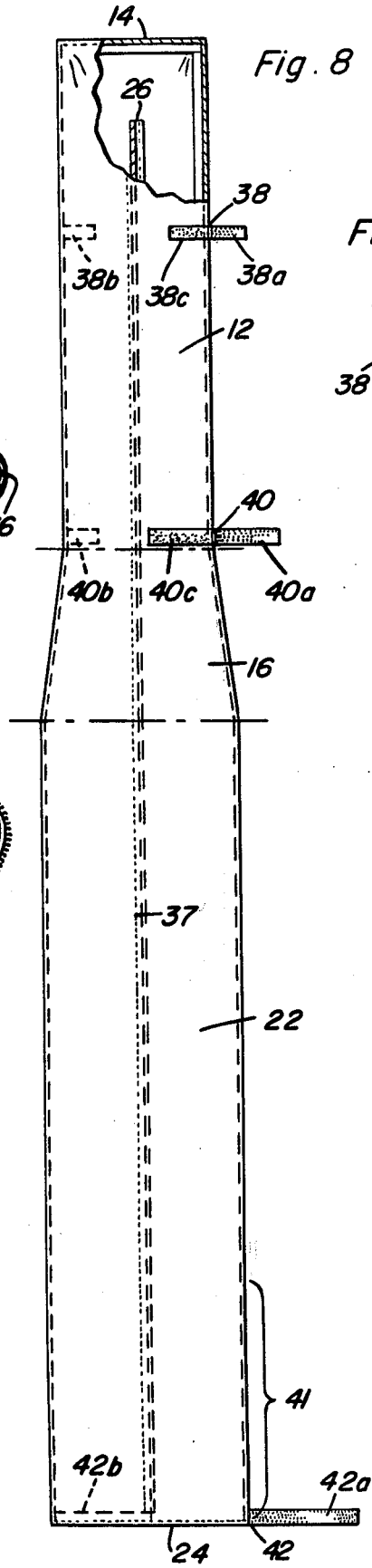
FIG. 8 is a plan view of the bag of the present invention.

The bag of the present invention, designated generally as 10, is most clearly seen in FIGS. 7 and 8. Referring to these FIGURES it can be seen that bag 10 consists of an elongated body having three identifiable integral portions. Front portion 12 is elongated and generally tubular and closed at its forward end 14. The front portion 12 is integral with an intermediate portion 16 which is of continuously increasing cross section from its forward, narrow end 18 to its rear, wide end 20. A rear portion 22 is integral with intermediate portion 16 at the latter's wide end 20. Rear portion 22 is elongated and tubular and of greater cross-sectional area than front portion 12. Rear portion 22 is open at its rear end 24. A partition 26, of flexible material, extends longitudinally of the body to divide the bag into two substantially equal compartments 28 and 30. As can be seen in FIG. 7, the bag 10 is of generally oval cross-sectional configuration and is formed in two longitudinally extending halves, an upper half 32 and a lower half 34, which halves are connected together by a continuous longitudinally extending seam 36. The longitudinal edges of partition 26 are preferably secured longitudinally of the body by stitching 37 to body halves 32 and 34. It will be appreciated that the manner of securing the halves 32 and 34 and the partition 26 thereto may vary and any suitable securing technique may be employed.

To use bag 10, one ski is inserted on each side of partition 26 in each of compartments 28 and 30 with the forward end (or curved end) of the skis extending into the front portion 12 of the bag. The bindings on the skis are accommodated by the enlarged cross-sectional area of the bag in rear portion 22. Once the skis are inside the bag they can be shifted to different positions and held in these positions by suitable fasteners to be more fully discussed hereinafter. Regardless of the position of the skis in the bag, due to partition 26, no part of the two skis can touch each other. Bag 10 is intentionally designed to be longer than the skis it is to house. The rear end section 41 of the rear portion 22 is adapted to be folded back on itself to adapt the length of the bag to the length of the skis. Also, by folding the rear end section 41 back on itself, the bag becomes totally enclosed to protect the skis from the elements.

A plurality of fastening means 38, 40 and 42, are distributed along the length of bag 10 to snugly gather and fasten the bag to the skis and thereby to hold the skis securely in position in their respective compartments. Any suitable separable fastening means, such as straps and buckles, tie cords, and the like are functional although the preferred fastening means are velvet pile type fabric fasteners which include interengaging hooks on opposite superposed pieces. Mere pressure exerted on superposed velvet-type fabrics having facing piles is sufficient to engage their respective hooks. Velvet type fabrics hook fasteners suitable for use with bag 10 are disclosed in U.S. Pat. Nos. 2,717,437 and 3,009,235. While the fastening means may be disposed at any number of convenient locations along the length of bag 10 it is particularly preferred to locate one fastening means 38 on front portion 12, a second fastening means 40 at about the point of intersection of the front and intermediate portions, and a third fastening means 42 at the extreme rear end 24. When the preferred velvet type fabric hook fasteners are employed, it will be appreciated that each fastener consists of two mating parts, in effect a male and female fabric section. Thus, for example, fastening means 38 consists of a male velvet fabric tape 38*a* extending sidewardly from one side of front portion 12 and an oppositely facing female velvet fabric tape 38*b* (shown in phantom on FIG. 8) on the opposite side of bag 10. In order for tape 38*a* to reach tape 38*b* to engage therewith, the bag material between them must be folded or gathered against the skis in the bag. In addition, fastening means 38 includes a second female velvet fabric tape 38*c* adjacent tape 38*a* to permit folding the bag in a flat position and storing the bag with tape 38*a* secured in a closed position. Fastening means 40 is the same fastening means 38 and includes fabric tapes 40*a*, 40*b* and 40*c*. Likewise, fastening means 42 includes a male fabric tape 42*a* and a female tape 42*b*, but does not include a second female fabric tape since, when the bag is folded, tapes 42*a* and 42*b* are engaged to hold the bag in its folded position (see FIG. 10).

Figure 1:
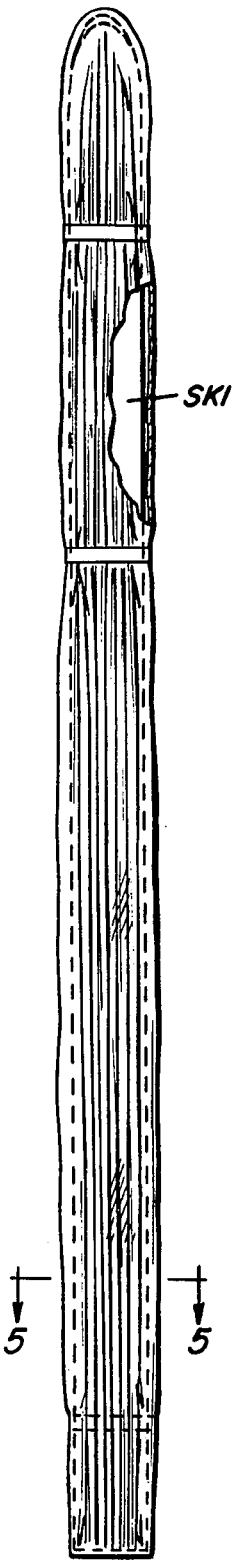
FIG. 1 is a plan view of the bag of the present invention enclosing a pair of skis in bottom-to-bottom relation.
Figure 2:
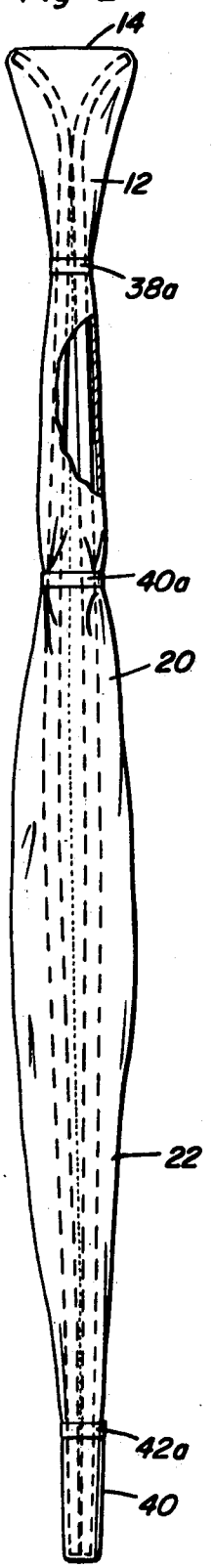
FIG. 2 is a side elevational view of the bag of FIG. 1.
Figure 3:
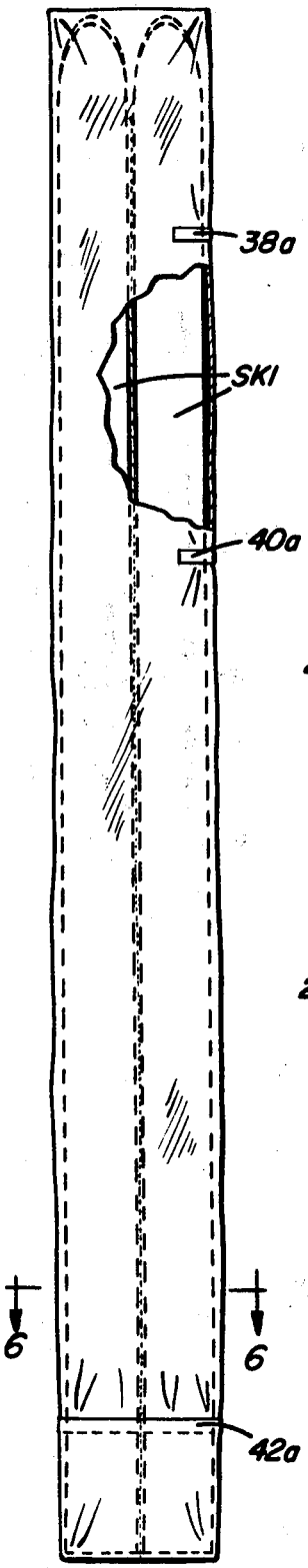
FIG. 3 is a plan view of the bag of the present invention enclosing a pair of skis in side-by-side relation.
Figure 4:
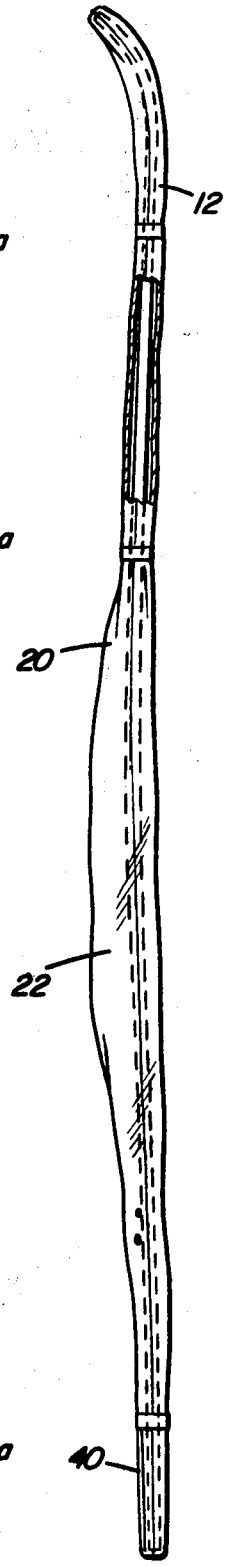
FIG. 4 is a side elevational view of the bag of FIG. 3.
Figure 5:
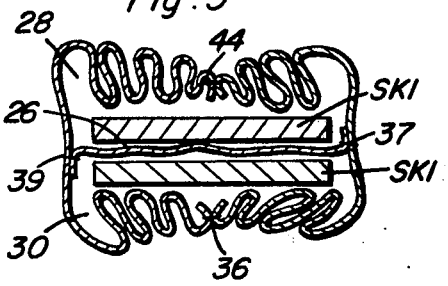
FIG. 5 is a sectional view taken substantially along line 5—5 in FIG. 1.
Figure 6:
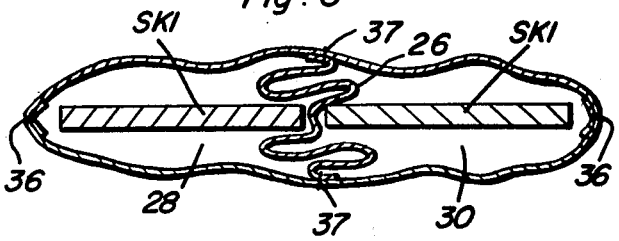
FIG. 6 is a sectional view taken substantially along line 6—6 in FIG. 2.

Referring now to FIG. 1, 2 and 5 there is shown the bag 10 enclosing a pair of skis with the skis in bottom-to-bottom configuration. After the individual skis are inserted into their respective compartments 28 and 30, the rear end section 41 is folded back upon itself to enclose the bottom of the bag, and tape 42*a* is wrapped around the skis to gather the bag material and hold it snugly against the skis and to engage tape 42*b*. Likewise, tapes 40*a* and 38*a* are snugly wrapped around the skis to gather the bag material against the skis and to engage tapes 40*b* and 38*b* respectively. The excess bag material 44 between the tapes falls loosely around the skis. The skis may alternatively be placed in the bag in side-by-side relation as shown in FIGS. 3, 4 and 6. Again, after the skis are inserted into their respective compartments 28 and 30, the rear end section 41 is folded back onto itself to enclose the bottom of the bag and fastening tapes 38*a*, 40*a* and 42*a* are wrapped around the skis to engage tapes 38*b*, 40*b* and 42*b*, respectively. It is noteworthy that notwithstanding the configuration of the skis within the bag, the fastening means holds the bag closely adjacent the skis to securely hold the skis in place in their compartments. It is also noteworthy that partition 26 at all times prevents contact between the skis.

To adjust the position of the skis from side-by-side to bottom-to-bottom or vice versa, all that is necessary is to open fastening means 38 and 40 and loosen fastening means 42 and then to shift the skis while they are still in the bag. Next, the bag material is tucked tightly around the skis at the fastening means and the respective fastening means are engaged and/or tightened, as necessary.

Figure 10:
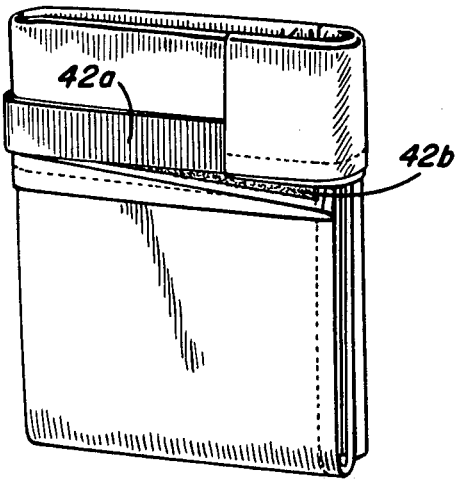
FIG. 10 is a perspective view of the bag of FIG. 8 in fully folded condition.
Figure 9:
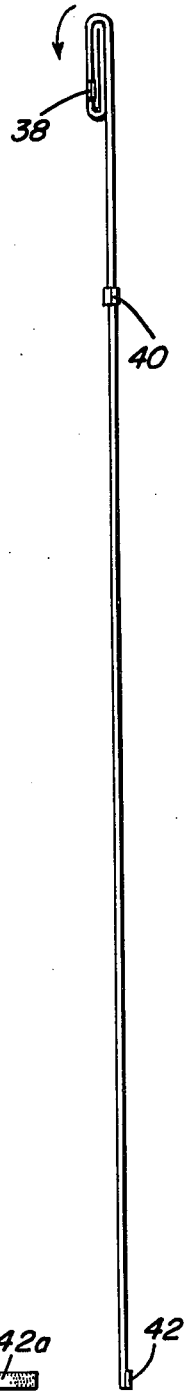
FIG. 9 is a side elevational view showing the manner in which the empty bag of FIG. 8 may be folded.

As hereinbefore indicated, the bag 10 of the present invention is readily foldable into a very small package for storage in a pocket. FIG. 9 illustrates the manner in which folding is accomplished. First, tapes 38*a* and 40*a* are engaged with tapes 38*c* and 40*c*. Next, the front end 14 is folded over a few inches onto itself and the folded section folded longitudinally onto the bag a number of times until the entire length of the bag has been folded into a section only a few inches long. Then, the resulting section is folded transversely onto itself and fastened in this folded position by engagement of tapes 42*a* and 42*b*, as shown in FIG. 10.

While the present invention has been described with reference to particular embodiments thereof, it will be understood that numerous modifications can be made by those skilled in the art without actually departing from the scope of the invention. Accordingly, all modifications and equivalents may be resorted to which fall within the scope of the invention as claimed.

What is claimed as new is as follows:

1. A bag for carrying and storing a pair of skis therein, the bag being of a flexible, substantially waterproof material, comprising:

an elongated, generally tubular bag of a length sufficient to completely enclose a pair of skis in side-by-side relation, the bag having a closed front end for receiving the forward ends of the pair of skis and an open rear end for inserting the pair of skis, longitudinal, flexible partitioning means extending substantially the entire length of the bag forming side-by-side compartments with each compartment receiving one each of the pair of skis, and a plurality of separable fastenings means distributed along the length of the bag for fastening the bag around the skis and to hold the skis in position, with at least one of the fastening means disposed adjacent the open end of the rear of the bag.

2. The bag of claim 1 wherein the cross-sectional area of the rear portion is greater than the cross-sectional area of the front portion.

3. A bag for carrying and storing a pair of skis therein, the bag being of a flexible, substantially waterproof material, comprising:

an elongated, generally tubular bag of a length sufficient to completely enclose a pair of skis in side-by-side relation, the bag having a closed front end for receiving the forward ends of the pair of skis and an open end for inserting the pair of skis, the bag being longer than the skis, with the open end of the bag adapted to fold on itself to close the bag, a flexible partition in the bag extending longitudinally substantially the entire length of the bag forming side-by-side compartments with each compartment adapted to receive one each of the pair of skis and wherein the cross-section of each compartment along its length is sufficiently large to permit adjusting the position of the skis from bottom-to-bottom to side-by-side and vice versa without removing the skis from the bag, and separable fastening means distributed along the length of the bag for fastening the bag around the skis and to hold the skis in position, one of the fastening means disposed at the open rear end of the bag, one at the front of the bag and one intermediate of the front and rear of the bag, each fastening means being a pair of engageable velvet-type fabric tapes secured to the bag.

* * * * *